US008070526B2

(12) United States Patent
Zhu

(10) Patent No.: US 8,070,526 B2
(45) Date of Patent: Dec. 6, 2011

(54) ELECTRICAL CONNECTOR WITH IMPROVED TERMINALS ASSEMBLED TO INSULATIVE HOUSING FROM TOP TO BOTTOM

(75) Inventor: Yu Zhu, Shenzhen (CN)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 0 days.

(21) Appl. No.: 12/814,485

(22) Filed: Jun. 13, 2010

(65) Prior Publication Data

US 2011/0045705 A1 Feb. 24, 2011

(30) Foreign Application Priority Data

Aug. 19, 2009 (CN) ..... 2009 2 0308273
Aug. 19, 2009 (CN) ..... 2009 2 0308306

(51) Int. Cl.
*H01R 24/00* (2006.01)

(52) U.S. Cl. ..... 439/660

(58) Field of Classification Search ..... 439/660, 439/79, 924.1
See application file for complete search history.

(56) References Cited

U.S. PATENT DOCUMENTS 5,221,212 A * 6/1993 Davis ..... 439/108
5,295,843 A * 3/1994 Davis et al. ..... 439/108
5,641,308 A * 6/1997 Bixler et al. ..... 439/660
5,993,263 A * 11/1999 Sampson ..... 439/660
6,648,682 B1 * 11/2003 Wu ..... 439/567
6,746,281 B1 * 6/2004 Zhang ..... 439/637
6,832,934 B1 * 12/2004 Zhang ..... 439/660
6,840,809 B2 * 1/2005 Wu ..... 439/636
6,942,524 B2 * 9/2005 Wu ..... 439/637
7,238,054 B2 * 7/2007 Higeta et al. ..... 439/637
7,255,607 B1 * 8/2007 Wu ..... 439/660
7,300,317 B2 * 11/2007 Dillon et al. ..... 439/678
7,497,709 B1 * 3/2009 Zhang ..... 439/188
7,654,873 B2 * 2/2010 Luo et al. ..... 439/731
7,753,737 B2 * 7/2010 Yang et al. ..... 439/660
7,789,677 B2 * 9/2010 Yang et al. ..... 439/83
2010/0015836 A1 * 1/2010 Zhu ..... 439/329
2010/0055977 A1 * 3/2010 Zhu ..... 439/571

* cited by examiner

*Primary Examiner* — Tulsidas C Patel
*Assistant Examiner* — Vladimir Imas
(74) *Attorney, Agent, or Firm* — Wei Te Chung; Andrew C. Cheng; Ming Chieh Chang

(57) ABSTRACT

An electrical connector includes an insulative housing and a plurality of first terminals secured in the housing. The insulative housing includes a base with a front face, a tongue portion extending forwardly from the front face of the base and a plurality of passageways located on a first side face of the insulating housing. The passageways extend from the tongue portion to the base across the front face of the base. The passageways communicate with an exterior through the first side face along a whole length thereof. The plurality of first terminals are received and retained in the passageways. Each first terminal includes a contact portion located on the tongue portion and exposing to the first side face of the tongue portion, a retention portion located on the base portion and a tail portion.

20 Claims, 7 Drawing Sheets

ELECTRICAL CONNECTOR WITH IMPROVED TERMINALS ASSEMBLED TO INSULATIVE HOUSING FROM TOP TO BOTTOM

BACKGROUND OF THE INVENTION

1. Field of the Invention

The present invention relates to an electrical connector, and more particularly to an electrical connector with improved terminals assembled to a insulative housing from top to bottom so as to avoid moving backward of the terminals during mating with a corresponding connector.

2. Description of the Related Art

U.S. Pat. No. 6,832,934 issued on Dec. 21, 2004 discloses a Serial ATA electrical connector. The connector comprises an insulative housing defining a rear surface and a plurality of terminals secured in the housing. The housing comprises a base and a pair of mating tongues extending forwardly from the base. Each terminal comprises a horizontal retention portion, a contact portion extending forwardly from a front end of the retention portion and a tail portion extending rearward from a rear end of the retention portion. The terminals are assembled to the housing from the rear surface of the housing. When the connector mates with a mating connector, the terminals might move backward.

In view of the above, a new electrical connector that overcomes the above-mentioned disadvantages is desired.

SUMMARY OF THE INVENTION

Accordingly, an object of the present invention is to provide an electrical connector with improved terminals assembled to a insulative housing from top to bottom so as to avoid moving backward of the terminals during mating with a corresponding connector.

To fulfill the above-mentioned object, an electrical connector comprises an insulative housing and a plurality of first terminals secured in the housing. The insulative housing comprises a base with a front face, at least one tongue portion extending forwardly from the front face of the base and a plurality of passageways located on a first side face of the insulating housing. The passageways extend from the at least one tongue portion to the base across the front face of the base. The passageways communicate with an exterior through the first side face along a whole length thereof. The plurality of first terminals are received and retained in the passageways. Each first terminal comprises a contact portion located on the at least one tongue portion and exposing to the first side face of the at least one tongue portion, a retention portion located on the base portion and a tail portion.

Other objects, advantages and novel features of the invention will become more apparent from the following detailed description when taken in conjunction with the accompanying drawings.

DETAILED DESCRIPTION OF THE PREFERRED EMBODIMENT OF THE INVENTION

Figure 1:
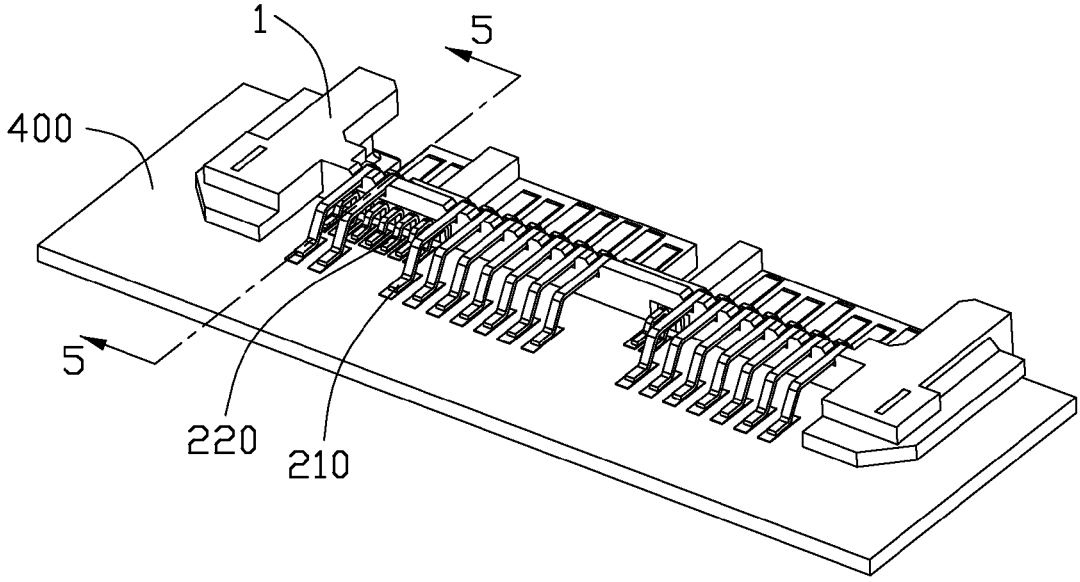
FIG. 1 is a perspective view of an electrical connector on a PCB in accordance with a first embodiment of the present invention.

The present invention will now be described in detail with reference to a preferred embodiment thereof as illustrated in the accompanying drawings. In the following description, numerous specific details are set forth in order to provide a thorough understanding of the present invention. It will be apparent, however, to one skilled in the art, that the present invention may be practiced without some or all of these specific details. In other instances, well known process steps have not been described in detail in order to not unnecessarily obscure the present invention.

Referring to FIGS. 1 to 5, an electrical connector 1 according to the first embodiment of the invention is mounted on a printed circuit board (PCB) 400 by means of a pair of board locks 300. The electrical connector 1 comprises an insulative housing 100 and a plurality of first terminals 210 and second terminals 220 secured in the insulative housing 100.

Figure 2:
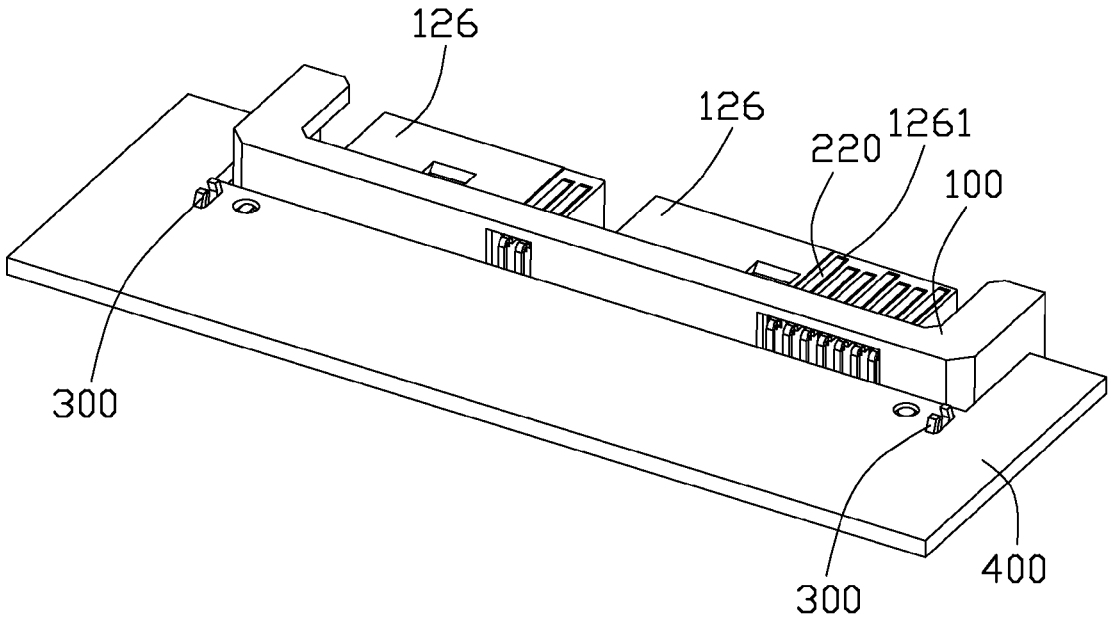
FIG. 2 is an another perspective view of the electrical connector on the PCB of FIG. 1.
Figure 3:
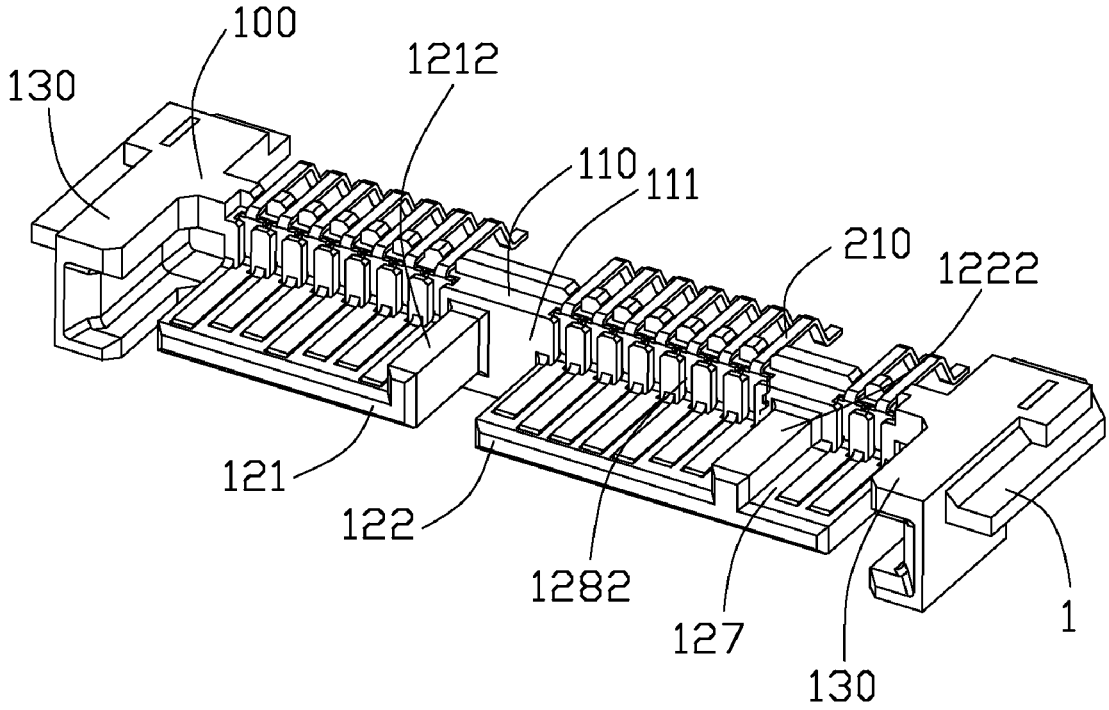
FIG. 3 is an another perspective view of the electrical connector of FIG. 1.
Figure 4:
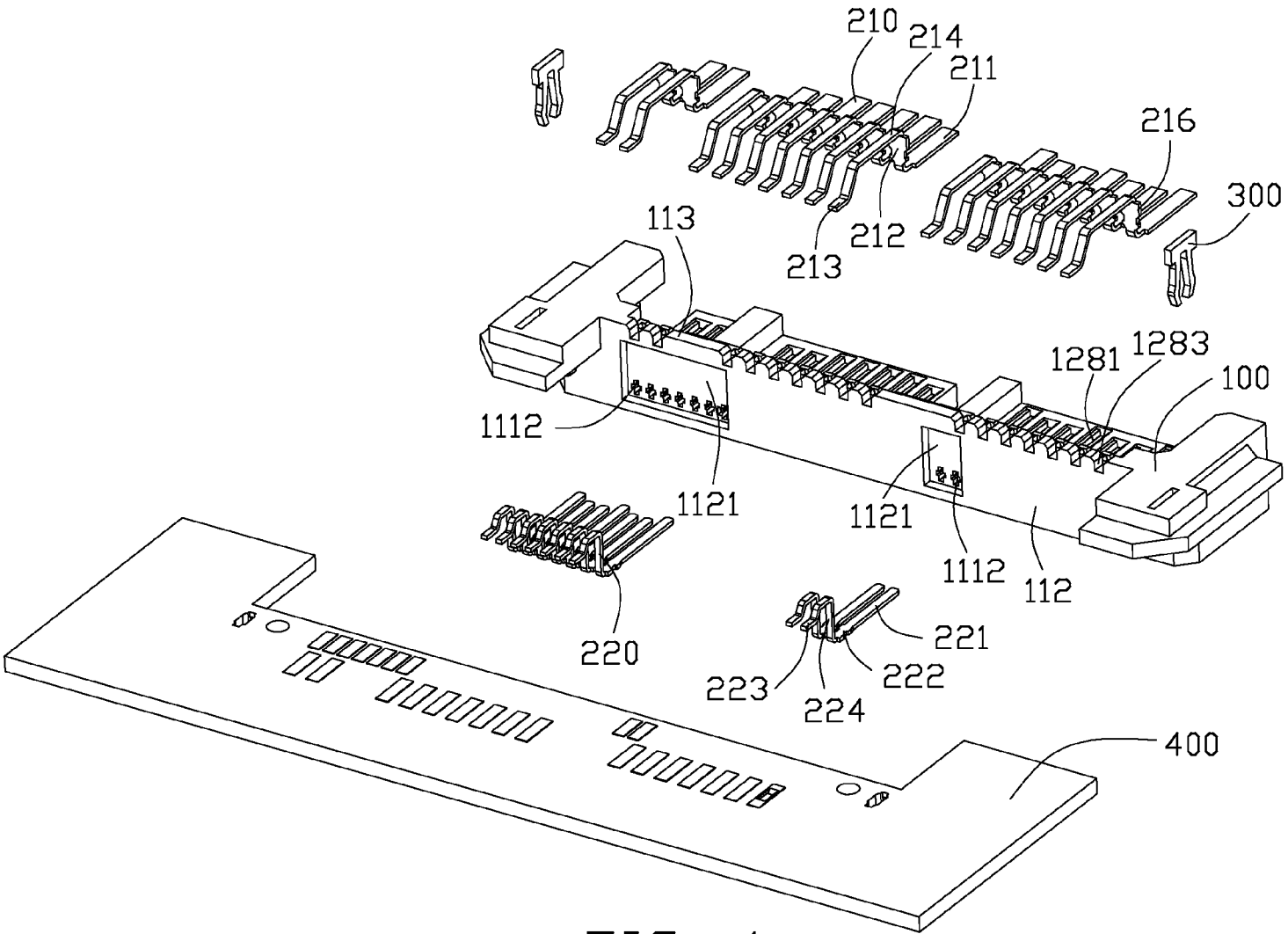
FIG. 4 is an exploded, perspective view of the electrical connector shown in FIG. 1.
Figure 5:
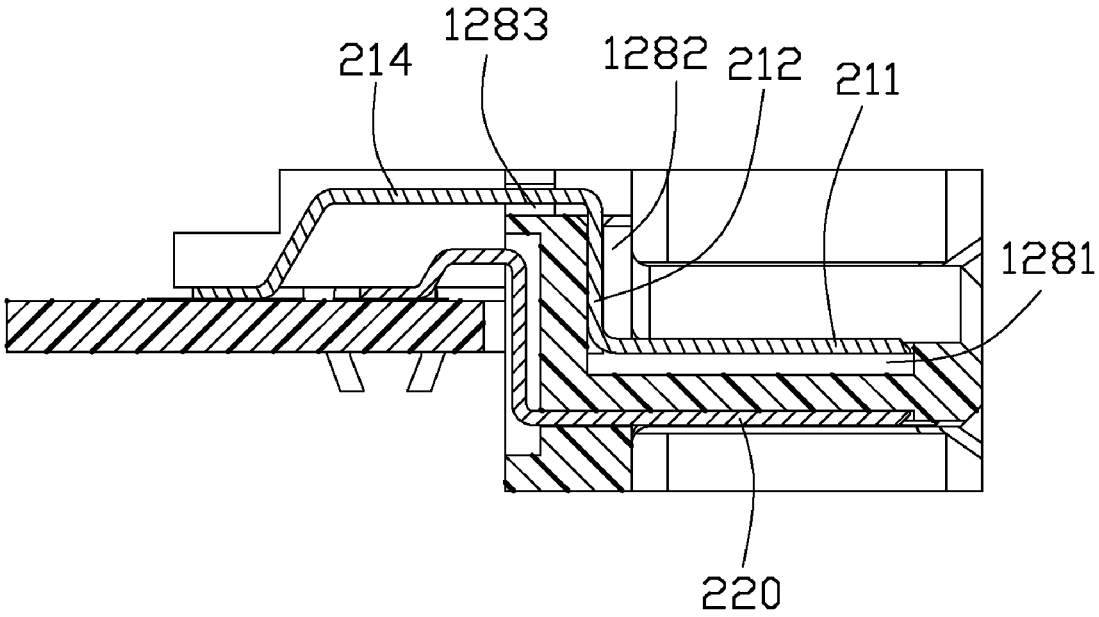
FIG. 5 is a sectional view of the electrical connector of FIG. 1, taken along a line 5-5 thereof.

Referring to FIGS. 3 to 4, the insulative housing 100 comprises an elongated base 110, a pair of guide portions 130 formed at two ends of the base 110, and a pair of tongue portions 121,122 with different dimensions located between the two guide portions 130. The base 110 defines a front face 111, a rear face 112 opposite to the front face 111 and a top face 113 connecting the front face 111 with the rear face 112. The pair of tongue portions 121,122 extends forwardly from the front face 111 of the base 110 and defines a top surface 127 and a bottom surface 126 labeled in FIG. 2 opposite to the top surface 127. Two projections 1212, 1222 extend upwardly from the top surface 127 of the two tongue portions 121,122 respectively. One projection 1212 is located at a lateral end of the narrower tongue portion 121, and the other projection 1222 is nearer to one end of the wider tongue portion 122. The top faces 113,127 are configured with a step shaped, i.e. the housing defines a step face including the top faces 113,127 and the front face 111. A plurality of first passageways 128 is formed in the step face of the housing 100. Each passageway 128 is defined as a line pattern and comprises a first section 1281 on the top surface 127 of the two tongue portions, a third section 1283 on the top face 113 of the base 110 and a second section 1282 on the front face 111 of the base, said three sections being lined. Please note, said three sections communicates an exterior through the top faces 127,110 and front face 111, i.e, the step face of the housing. The second section 1282 penetrate through the front face 111 and top face 110 of the base 110 and communicate with the corresponding first sections 1271 and the third sections 1283 at opposite ends thereof. Thus, the first terminals 210 can be inserted to the first passageways from the top face or step face of the housing which will described hereinafter. As best shown in FIGS. 2 and 5, a plurality of second passageways 1261 is formed in the bottom surface 126 to receive the second terminals 220.

Each first terminal 210 defines a plate contact portion 211, a retention portion 212 bending from a rear end of the contact portion 211 and perpendicularly extending upwardly, a connection portion 214 extending rearward from the retention portion 212 and a tail portion 213 extending downwardly and rearward from the connection portion 214. As best shown in FIG. 5, the connection portion 214 and the tail portion 213 are parallel to the contact portion 211 and the tail portion is higher than the contact portion and lower than the connection portion 214 so that the connector sinks in a notch of the PCB to lower the connector on the PCB. The contact portions 211 are received in the first section 1281 and expose to the top surfaces 127 of the tongue portions 121,122 so as to engage with mating terminals of a corresponding connector (not shown). The retention portions 212 are inserted in the second section 1282 and the connection portions are in the third section through the top face 113 of the base 110 and interfere with the inner walls of the first passageways during assembling the first terminals 210 to the housing 100. When the connector 1 engages with said corresponding connector in a front-to-back direction, the first terminals 210 would not move rearward since the retention portions are limited by the base 110.

Each second terminal 220 comprises a contact section 221, a retention section 222 at a rear end of the contact section 221 and a connection section 224 extending upwardly from the retention portion 222 and a tail section 223 extending rearward from the connection portion 224. The connection section 224 is perpendicular to the retention portion 222. The contact sections 221 are inserted in the corresponding second passageways 1261 from the back face 112 of the housing 100. The base 110 defines two hollow recesses 1121 in the rear face 112. The hollow recesses 1121 are corresponding to the second terminals 220 and adapted to enclose the connection sections 224. The connection sections 224 are perpendicular to the retention sections 222 and do not extend beyond the rear face 112 of the base 110 so as to prevent the second terminals 220 from damage. The tail portions 213 of the first terminals 210 and the tail sections 223 of the second terminals 220 are coplanar.

Figure 6:
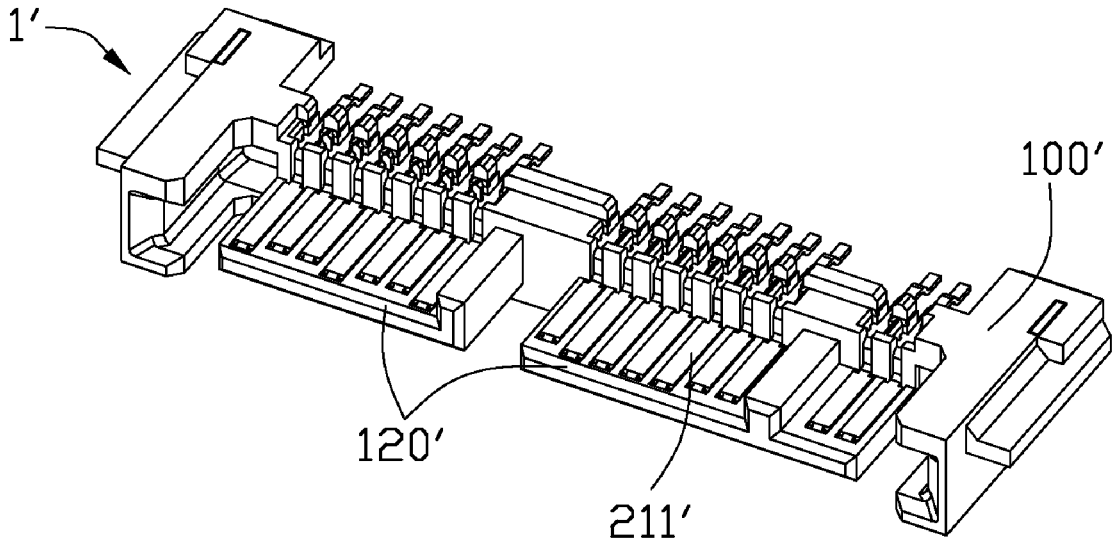
FIG. 6 is a perspective view of an electrical connector according to a second embodiment of the present invention.
Figure 7:
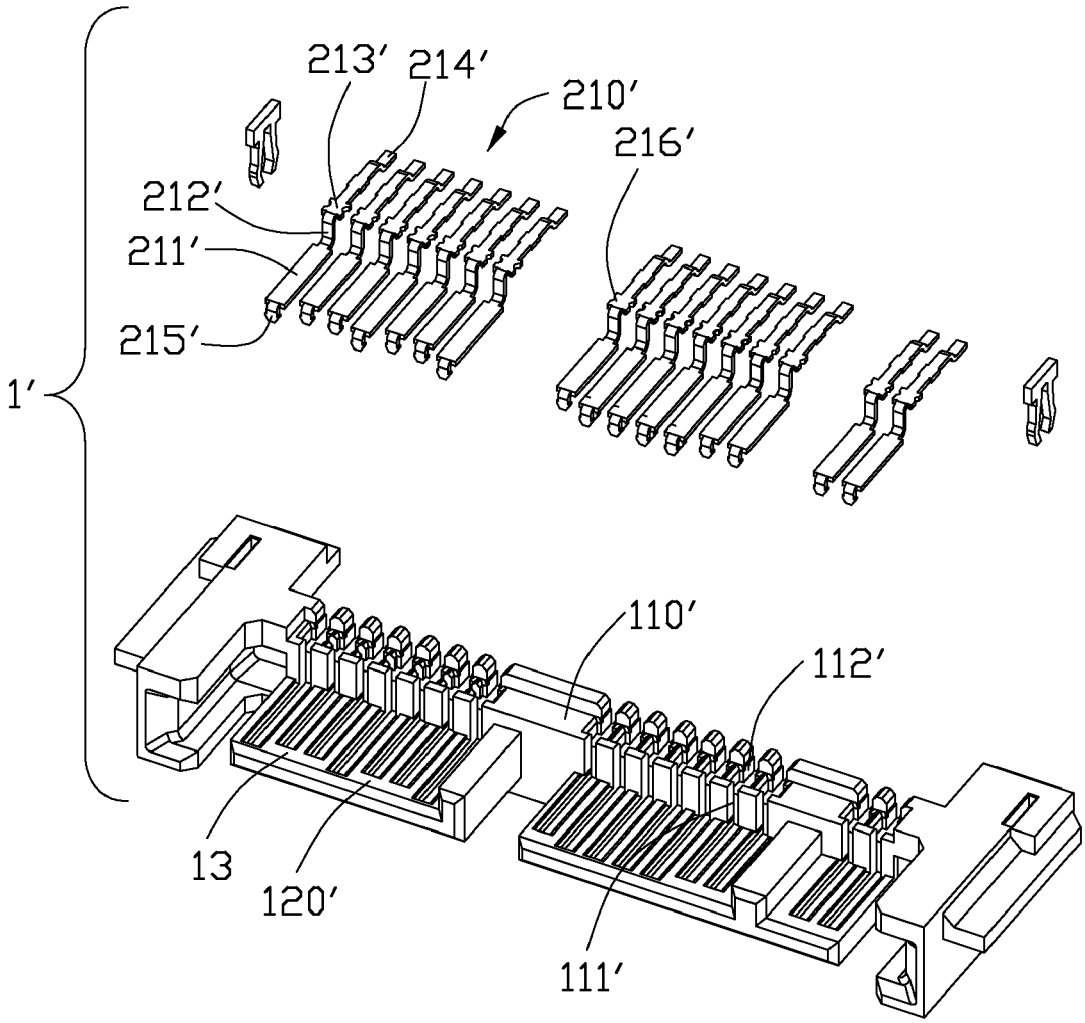
FIG. 7 is an exploded, perspective view of the electrical connector shown in FIG. 6.

Referring to FIGS. 6 and 7 showing a second embodiment, an electrical connector 1' comprises an insulative housing 100' and a plurality of terminals 210' secured in the housing 100'. The insulative housing 100' defines a base 110' and a tongue portion 120' extending forwardly from the base 110'. Each terminal 210' comprises a horizontal contact portion 211' exposing to the top surface of the tongue portion 120', a connection portion 212' perpendicularly extending upwardly from the contact portion 211', a horizontal retention portion 213' extending rearward from the connection portion 212' and a tail portion 214'. The base 110' defines a plurality of passageways 111' recessed downward on one side face (top face) 13 of the housing, which extend from the top face of the tongue portion to the top face of the base across the front face of the base. The contacts are inserted in the passageways 111' from the side face 13. Each terminal 210' further comprises a latch portion 215' extending downwardly from a free end of the contact portion 211' and is adapted to mate with a corresponding cavity formed in the tongue portion 120' so as to avoid warping of the terminal 210'. Please note barbs 216' labeled in FIG. 7 used for interference with the housing are on the horizontal portions (retention portions 213') of the contacts 210' of the second embodiment and the barbs 216 are on the upright portions (retention portions 212) of the first terminals 210 of the first embodiment. The contacts can be inserted in a direction perpendicular to the step side face of the housing as a common idea.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector comprising:

an insulative housing comprising a base with a front face, at least one tongue portion extending forwardly from the front face of the base and a plurality of passageways located on a first side face of the insulating housing which extend from the at least one tongue portion to the base across the front face of the base, the passageways communicating with an exterior through the first side face along a whole length thereof; and a plurality of first terminals received and retained in the passageways, each first terminal comprising a contact portion located on the at least one tongue portion, a retention portion located on the base portion and a tail portion extending rearward from the retention portion, the contact portion and the tail portion exposing to the first side face of insulative housing respectively.

2. The electrical connector as claimed in claim 1, wherein the retention portions are located on the front face of the base portion.

3. The electrical connector as claimed in claim 2, wherein the tail portions of the first terminals comprise connection portions extending from the retention portions and parallel to the contact portions, the connection portions are located on the base and communicate with the exterior through the first side face.

4. The electrical connector as claimed in claim 1, wherein the retention portions are parallel to the contact portions and located on the base.

5. The electrical connector claimed in claim 3, further comprising a plurality of second terminals located on a second side face opposite to the first side face of the insulative housing, each second terminal comprising a contact section located on the at least one tongue portion and a retention section running across a middle portion of the base and a tail section.

6. The electrical connector as claimed in claim 5, wherein the second terminals comprise connection sections extending from the retention section parallelly communicating in a hollow recess defined in a back face of the base.

7. The electrical connector as claimed in claim 5, wherein the second terminals comprise connection sections extending from the retention section parallelly communicating in a hollow recess defined in a back face of the base.

8. The electrical connector as claimed in claim 1, wherein the insulative housing comprises a pair of guide portions, said tongue portions are located between the two guide portions.

9. The electrical connector as claimed in claim 5, wherein the tail portions of the first terminals and the tail sections of the second terminals are coplanar.

10. An electrical connector assembly comprising:

a printed circuit board defining opposite first and second surfaces;

a notch formed in a front edge region of said printed circuit board;

an electrical connector including:

an insulative housing defining an elongated base receiving in the notch;

a mating port defined in front of the base;

a tongue portion forwardly extending from the base into the mating port, essentially located within the notch and defining opposite first and second faces thereon wherein the first face directs to a same first direction with the first surface and the second face directs to a same second direction with the second surface;

a pair of guiding portions located at two elongated ends of the base, each of said guiding portions being equipped with an outer horizontal plane seated upon the first surface of the printed circuit board;

a row of first contacts each having a first contacting portion seated upon the first face and directly communicating with the mating port in the first direction, a first retention portion extending from a rear section of the first contacting portion in said first direction, retained to the base and communicating forwardly with the mating port, a first connecting portion extending rearwardly from an upper section of the first retention portion and above said first surface, and a first tail portion mounted to the printed circuit board; wherein the housing and the first contacts are configured to allow each of said first contacts to be assembled to the housing in the second direction while the whole first contact is essentially exposed to an exterior or the mating port after assembled.

11. The electrical connector assembly as claimed in claim 10, wherein the first face is lower than the said first surface in said first direction.

12. The electrical connector assembly as claimed in claim 11, wherein said first face is essentially at a same level with the second surface.

13. The electrical connector assembly as claimed in claim 10, wherein said connector further includes a row of second contacts of which, each defines a second contacting portion exposed upon the second face, a second retention portion extending from a rear section of the second contacting portion in the first direction, retained to the base and communicating rearwardly with the exterior, a second connecting portion connected to an upper section of the second retention portion, and a second tail portion mounted to the printed circuit board under condition that said second contacts are assembled to the housing forwardly from a rear side of the housing and not all said second contact is essentially exposed to the exterior or the mating port.

14. The electrical connector assembly as claimed in claim 13, wherein said first face is located below the first surface and said second face is located below the second surface in said first direction.

15. The electrical connector assembly as claimed in claim 13, wherein the second retention portion is disposed in a hollow recess formed in a rear face of the base not to directly contact an inner edge of the printed circuit board adjacent to the notch.

16. The electrical connector assembly as claimed in claim 13, wherein both said first tail portion and said second tail portion are soldered upon the first surface.

17. An electrical connector comprising:

an insulative housing comprising a base defining a front face and a tongue portion extending forwardly from the front face of the base, the insulative housing defining opposite first outer surface and second outer surface;

a plurality of first terminals assembled in a first direction perpendicular to the tongue portion and retained at the first outer surface of the insulative housing; and a plurality of second terminals assembled in a second direction parallel to the tongue portion, partial portions of the second terminals retained at the second outer surface of the insulative housing; wherein each of the first and second terminal comprising a vertical portion respectively, the vertical portion of the first terminal is located in the front of the base while the vertical portion of the second terminal is located behind the base.

18. The electrical connector assembly as claimed in claim 17, further including a printed circuit board with a notch into which the housing is received, wherein the first terminals are located more away from the printed circuit board than the second terminals.

19. The electrical connector assembly as claimed in claim 18, wherein the printed circuit board defines opposite upper and lower surfaces, and an upper face of the tongue portion is essentially coplanar with the lower surface and tails of the first and second terminals are commonly mounted to the upper surface.

20. The electrical connector assembly as claimed in claim 17, wherein the first terminals are located above the second terminals, and each of said first terminals is equipped with a vertical retention section to engage the housing.

* * * * *